US011031149B1

(12) United States Patent
Innes

(10) Patent No.: US 11,031,149 B1
(45) Date of Patent: Jun. 8, 2021

(54) NUCLEAR ABRASIVE SLURRY WASTE PUMP WITH BACKSTOP AND MACERATOR

(71) Applicant: AGI Engineering, Inc., Stockton, CA (US)

(72) Inventor: Alex Innes, Lodi, CA (US)

(73) Assignee: AGI ENGINEERING, INC., Stockton, CA (US)

( * ) Notice: Subject to any disclaimer, the term of this patent is extended or adjusted under 35 U.S.C. 154(b) by 163 days.

(21) Appl. No.: 16/224,179

(22) Filed: Dec. 18, 2018

Related U.S. Application Data

(60) Provisional application No. 62/630,026, filed on Feb. 13, 2018.

(51) Int. Cl.
*G21F 9/20* (2006.01)
*F04C 13/00* (2006.01)
(Continued)

(52) U.S. Cl.
CPC ..... *G21F 9/20* (2013.01); *F04C 13/008* (2013.01); *F04C 15/0057* (2013.01); *F04C 25/00* (2013.01); *F04D 7/045* (2013.01); *F04C 2210/60* (2013.01); *F04C 2230/92* (2013.01); *F04C 2240/20* (2013.01)

(58) Field of Classification Search
CPC ..... G21F 9/22; G21F 9/20; G21F 9/24; G21F 9/26; F04D 29/70; F04D 29/708; F04D 7/045; F04D 13/046; F04D 13/16; F04D 13/086; F04C 13/008; F04C 25/00; F04C 15/0057; F04C 2210/60; F04C 2230/92; F04C 2240/20; F04C 2240/811; B01D 35/26; B01D 29/014; B01D 29/03; B01D 29/035; B01D 35/027; B01D 35/28; B01D 35/31; B01D 2201/204; B01D 2201/31;
(Continued)

(56) References Cited

U.S. PATENT DOCUMENTS 1,611,326 A 12/1926 Abbe
2,461,433 A 2/1949 Moulten et al.
(Continued)

FOREIGN PATENT DOCUMENTS

DE 2618951 A1 * 11/1976 ..... F04D 29/108
EP 1166903 1/2002
(Continued)

OTHER PUBLICATIONS

Machine Translation of German Patent DE 2618951 A1 to Bleijenberg, Gerrit published Nov. 11, 1976.*
(Continued)

*Primary Examiner* — Peter J Bertheaud
*Assistant Examiner* — Dnyanesh G Kasture
(74) *Attorney, Agent, or Firm* — Brian S. Steinberger; Hilary F Steinberger; Law Offices of Brian S. Steinberger, P.A.

(57) ABSTRACT

Nuclear abrasive slurry waste pump systems, devices, and methods for retrieving waste materials and/or other material from storage tanks with liquefied tank material. The systems, devices and methods can work with tanks having high temperature conditions up to approximately 212 degrees Fahrenheit or low temperature conditions down to approximately 32 degrees Fahrenheit.

20 Claims, 8 Drawing Sheets

(51) Int. Cl.
*F04C 15/00* (2006.01)
*F04C 25/00* (2006.01)
*F04D 7/04* (2006.01)

(58) Field of Classification Search
CPC ..... F04B 53/16; F04B 53/20; B01F 7/161; B01F 7/1615; B01F 15/0298
See application file for complete search history.

(56) References Cited

U.S. PATENT DOCUMENTS 2,611,523 A 9/1952 Aines
2,668,625 A 2/1954 Garland
2,669,941 A 2/1954 Stafford
2,682,886 A 7/1954 Paxton
2,761,297 A 9/1956 Buchsteiner
2,819,803 A 1/1958 Obenchain
2,833,422 A 5/1958 Ferwerda et al.
2,985,192 A 5/1961 Taylor et al.
2,999,600 A 9/1961 Gates
3,060,972 A 10/1962 Sheldon
3,095,044 A 6/1963 Medlock
3,116,021 A 12/1963 Born
3,155,048 A 11/1964 Mandelbaum et al.
3,161,490 A 12/1964 Dudek
3,162,214 A 12/1964 Bazinet, Jr.
3,190,286 A 6/1965 Stokes
3,224,376 A * 12/1965 Schade ..... F04D 29/2288 415/121.1
3,266,059 A 8/1966 Stelle
3,274,850 A 9/1966 Tascio
3,305,220 A 2/1967 Nevulis
3,469,712 A 9/1969 Haulotte
3,497,083 A 2/1970 Anderson et al.
3,580,099 A 5/1971 Mosher
3,599,871 A 8/1971 Ruppel
3,757,697 A 9/1973 Phinney
3,788,338 A 1/1974 Burns
3,845,596 A 11/1974 Veenstra
3,863,844 A 2/1975 McMillan
3,889,818 A 6/1975 Wennerstrom
3,932,065 A 1/1976 Ginsberg et al.
3,951,572 A 4/1976 Ray, Jr. et al.
4,106,671 A 8/1978 Sharples
4,132,041 A 1/1979 Van Den Broek
4,156,331 A 5/1979 Lester et al.
4,250,933 A 2/1981 Olson
4,339,232 A 7/1982 Campbell
4,393,728 A 7/1983 Larson et al.
4,396,093 A 8/1983 Zimmerman
4,415,297 A 11/1983 Boring
4,494,417 A 1/1985 Larson et al.
4,534,869 A * 8/1985 Seibert ..... B01D 36/04 210/241
4,540,869 A 9/1985 Yasuoka
4,630,741 A 12/1986 Stevens
4,661,039 A 4/1987 Brenholt
4,685,349 A 8/1987 Wada et al.
4,817,653 A 4/1989 Krajicek et al.
4,828,461 A 5/1989 Laempe
4,848,179 A 7/1989 Ubhayakar
4,893,986 A * 1/1990 Catterfeld ..... F04D 1/10 415/100
4,898,513 A * 2/1990 Hon ..... F04D 15/00 210/238
4,944,535 A 7/1990 Maupin
4,945,955 A 8/1990 Murphy
4,977,790 A 12/1990 Nishi et al.
5,007,803 A 4/1991 Divito et al.
D326,336 S 5/1992 Christ
5,172,710 A 12/1992 Harrington
5,174,168 A 12/1992 Takagi et al.
5,297,443 A 3/1994 Wentz
5,439,020 A 8/1995 Lockhart
5,451,135 A 9/1995 Schempf et al.
5,515,654 A 5/1996 Anderson
5,518,553 A 5/1996 Moulder
5,540,172 A 7/1996 Goldbach et al.
5,607,000 A 3/1997 Cripe et al.
5,659,214 A * 8/1997 Guardiani ..... F04D 7/045 310/87
5,715,852 A 2/1998 Jepsen
5,740,821 A 4/1998 Arnold
5,913,320 A 6/1999 Varrin, Jr. et al.
6,213,135 B1 4/2001 Moulder
6,264,434 B1 7/2001 Frank
6,273,790 B1 8/2001 Neese et al.
6,280,408 B1 8/2001 Sipin
6,361,272 B1 * 3/2002 Bassett ..... E21B 43/128 415/121.1
6,561,368 B1 5/2003 Sturm, Jr. et al.
6,651,837 B2 11/2003 Stradinger et al.
6,830,079 B1 12/2004 Ahrens et al.
6,889,920 B2 5/2005 Nance et al.
6,938,691 B2 9/2005 Face
7,021,675 B2 4/2006 Lawson
7,032,628 B2 4/2006 Guillemette et al.
7,100,631 B2 9/2006 Liu et al.
7,241,080 B2 7/2007 Klobucar et al.
7,708,504 B2 5/2010 Heckendorn et al.
7,998,251 B2 8/2011 Pondelick et al.
8,069,747 B2 12/2011 Buckingham et al.
8,205,522 B2 6/2012 Buckingham et al.
8,347,563 B2 1/2013 Anderson
8,414,246 B2 4/2013 Tobey
8,702,399 B2 4/2014 Krohn
8,727,671 B2 5/2014 Sundholm
8,763,855 B1 7/2014 Harvey et al.
8,840,087 B2 9/2014 Guyard
9,195,238 B2 11/2015 Roden et al.
10,280,063 B2 5/2019 Innes et al.
10,406,571 B2 9/2019 Innes et al.
2002/0002426 A1 1/2002 Burkhard
2002/0191488 A1 * 12/2002 Araoka ..... F04D 7/045 366/264
2005/0025573 A1 2/2005 Waldman et al.
2005/0109376 A1 5/2005 Gregory
2005/0166413 A1 8/2005 Crampton
2006/0054189 A1 3/2006 Luke et al.
2006/0054202 A1 3/2006 Luke et al.
2008/0148876 A1 6/2008 Hock et al.
2010/0221125 A1 9/2010 Fulkerson et al.
2010/0229544 A1 * 9/2010 Bollinger ..... F15B 21/14 60/413
2010/0234988 A1 9/2010 Buckingham et al.
2010/0264013 A1 10/2010 Burton
2011/0186657 A1 8/2011 Haviland
2011/0197692 A1 * 8/2011 Bayer ..... F16H 25/06 74/412 R
2011/0315165 A1 12/2011 McWhorter
2012/0106882 A1 5/2012 Ponnouradjou et al.
2012/0279537 A1 11/2012 Peeters et al.
2014/0079573 A1 3/2014 Pabst
2014/0147299 A1 * 5/2014 Tomter ..... F04C 15/0092 417/228
2015/0034176 A1 2/2015 Garcia Arguelles et al.
2015/0124242 A1 5/2015 Pierce et al.
2015/0139792 A1 * 5/2015 Ramsey ..... F04C 13/005 415/213.1
2015/0299636 A1 * 10/2015 Virtanen ..... B01F 15/00662 435/303.3
2015/0362000 A1 12/2015 Schmidt et al.
2016/0010648 A1 * 1/2016 Han ..... F04D 17/10 417/420
2016/0055268 A1 2/2016 Bell et al.
2016/0107207 A1 4/2016 Desormeaux
2016/0145980 A1 * 5/2016 Cunningham ..... F04B 17/03 417/423.3
2017/0173617 A1 6/2017 Zilai et al.

(56) References Cited

U.S. PATENT DOCUMENTS

| | | | | |
|---|---|---|---|---|
| 2017/0259309 | A1 | 9/2017 | Innes et al. | |
| 2019/0195020 | A1 * | 6/2019 | Kapoor | F16H 39/42 |

FOREIGN PATENT DOCUMENTS

| | | | | |
|---|---|---|---|---|
| EP | 3151246 | A1 | 4/2017 | |
| GB | 1568888 | A1 * | 8/2005 | F04D 29/607 |
| IN | 201741036558 | A | 10/2017 | |
| JP | 2004301665 | A | 10/2004 | |
| WO | 2009018599 | | 2/2009 | |
| WO | 2014019852 | A1 | 2/2014 | |

OTHER PUBLICATIONS

Pearson, M.J., et al., "Biomimetic Vibrissal Sensing for Robots," Philosophical Transactions of the Royal Society B (2011), vol. 366, pp. 3085-3096, 12 pages.

Innes, Alex, G., PCT Patent Application No. PCT/US/19/068359, filed Dec. 23, 2019, Notification of Transmittal of the International Search Report and the Written Opinion of the International Search Authority, or the Declaration dated Feb. 25, 2020, 14 pages.

Bullseye Pumps, Bullseye B200-SPDK Vacuum Loading Solids Pump, 2017, retrieved from http://www.bullseyepumps.com/products/bullseye-b200-spdk-vacuum-loading-solids-pump?variant=31478670788, 10 pages.

Sykes Pumps, General Purpose, GP50 Pump Performance, 2017, retrieved from http://www.sykespumps.com.sa/pumps/product-specs/gp_50_75.html, 2 pages.

Pentair Southern Cross, SX60 Portable Slurry Pump, 2017, retrieved from http://www.southerncross.pentair.com.au/product/market/pumps/vacuum-pumps/sx60-portable-slurry-pump/, 3 pages.

Wastecorp. Pumps, Super Duty, TVP-65 Series Vacuum Pumps, 2017, brochure, 1 page.

RITCHIESpecs, Gradall 534D-9-45 Telescopic Forklift, 2017, retrieved from www.ritchiespecs.com, 2 pages.

Boom, Gradall Material Handler 534 D-61534 D-6 Turbo, Jul. 2002, 1 page.

Manitowoc, National Crane 600H Series Product Guide, 2012, 16 pages.

Manitowoc, National Crane 680H-TM, Aug. 2015, 4 pages.

Festo, Bionic Handling Assistant, Apr. 2012, 6 pages.

Schutz, Maxon Motor, Robotic Snake-Arm Flies into Tight Spaces, 2012, 4 pages.

McMahan, W., et al., Field Trials and Testing of the OctArm Continuum Manipulator, IEEE, May 2006, pp. 2336-2341, 6 pages.

Li, Z., et al., A Novel Tele-Operated Flexible Robot Targeted for Minimally Invasive Robotic Surgery, Engineering Research Robotics Article, Mar. 2015, pp. 073-078, vol. 1, issue 1, 6 pages.

Li, Z., et al., Kinematic Comparison of Surgical Tendon-Driven Manipulators and Concentric Tube Manipulators, Mechanism and Machine Theory, 2017, pp. 148-165, vol. 107, 18 pages.

Military Elevation Solutions and Tactical Trailers, KVL and KVR Telescopic Cable-Drive Masts, Sep. 2016, 3 pages.

OCRobotics, Laser Snake 2, Snake-arm robot and high-power laser integration, www.ocrobotics.com, 2016, 4 pages.

OCRobotics, Nuclear decommissioning case-study: Laser Snake, Snake-arm robot and high-power laser integration, www.ocrobotics.com, 2016, 4 pages.

Bauer, et al., Development and Deployment of the Extended Reach Sluicing System (ERSS) for Retrieval of Hanford Single Shell Tank Waste—14206 (Draft), U.S. Department of Energy, Assistant Secretary for Environmental Management, Washington River Protection Solutions, Nov. 2013, 19 pages.

Innes, PCT Patent Application No. PCT/US17/18120 filed Feb. 16, 2017, Notification of Transmittal of the International Search Report and the Written Opinion of the International Searching Authority, or the Declaration dated May 10, 2017, 14 pages.

Innes, PCT Patent Application No. PCT/US17/18120 filed Feb. 16, 2017, Notification Concerning Transmittal of International Preliminary Report on Patentability, 12 pages.

Oceaneering International, Inc., PCT Patent Application No. PCT/US18/060093, filed Nov. 9, 2018, Notification of Transmittal of the International Search Report and The Written Opinion of the International Searching Authority, or the Declaration dated Feb. 5, 2019, 3 pages.

Innes, Alex. G., PCT Patent Application No. PCT/US/19/036567, filed Jun. 11, 2019, Notification of Transmittal of the International Search Report and the Written Opinion of the International Search Authority, or the Declaration dated Sep. 17, 2019, 7 pages.

Lane, et al. "FY10 Engineering Innovations, Research and Technology Report" In: Lawrence Livermore National Lab. Jan. 31, 2011 (Jan. 31, 2011) Retrieved on Aug. 10, 2019 (Aug. 10, 2019) from https://e-reports-ext.llnl.gov/pdf/461932.pdf, 99 pages.

* cited by examiner

NUCLEAR ABRASIVE SLURRY WASTE PUMP WITH BACKSTOP AND MACERATOR

This application claims the benefit of priority to U.S. Provisional Patent Application Ser. No. 62/630,026 filed Feb. 13, 2018, which is incorporated by reference in its' entirety.

FIELD OF INVENTION

This invention relates to the retrieving of chemical, radioactive, hazardous and/or other waste and/or material from storage tanks; and in particular, to nuclear waste slurry pump systems, devices, and methods for retrieving waste materials and/or other material from storage tanks with liquefied tank material, the systems, devices and methods can work with tanks having high temperature conditions up to approximately 212 degrees Fahrenheit or low temperature conditions down to approximately 32 degrees Fahrenheit.

BACKGROUND AND PRIOR ART

At nuclear waste storage facilities, radioactive material is stored in underground storage tanks. These tanks typically have small openings down to 12" in diameter for access of equipment. Various cleaning methods have been used to break up and retrieve waste material located in these tanks. A high flow of water liquefies and motivates waste into a stream. Typically, a pump sits in the stream to capture and transfer the waste to a remote storage tank. Traditional abrasive slurry pumps are sized to keep fluid velocities at a minimum, thus reducing wear on the pump.

However, these pumps are too large to fit through a 12-inch diameter riser pipe. To fit, the pump can be reduced in size, but this also reduces the pump output and won't meet flow requirements to prevent solids from settling during transfer. To make up for the decreased flow rates, the pump can be sped up; however, this causes excessive wear on the pump.

Also, when a stream of waste is flowing towards the pump, a large portion of the liquid and particles can flow past the pump. Once the stream passes the pump, multiple steps must be implemented to properly capture the waste greatly increasing operation costs and the overall time to effectively clean a tank.

Furthermore, particles in the abrasive slurry can be too large to pass into the pump requiring additional methods or operational time to remove.

Thus, the need exists for solutions to the above problems with the prior art.

SUMMARY OF THE INVENTION

A primary objective of the invention is to provide nuclear abrasive slurry waste pump systems, devices, and methods for retrieving waste materials and/or other material from storage tanks with liquefied tank material.

A secondary objective of the invention is to provide pumping solution systems, devices and methods for the removal of liquid and solid waste from nuclear waste tanks through existing riser pipes approximately 12-inch in diameter. Keeping solids suspended in the waste stream as it is pumped out of a tank requires a high-power density, which this invention achieves via a 4-stage, hydraulically-driven pump.

A third objective of the invention is to provide hydraulically driven pump systems, devices, and methods which eliminate an ignition source and potential in-tank explosion that is associated with electrical power.

The pump hydraulic motor can be located on the pump within the tank, which allows for the mechanical seals separating the hydraulic fluid from the waste stream to also be located in the tank, eliminating the possibility of hazardous or nuclear waste leaking out and being transported above ground through the hydraulic system in the event of a seal failure.

In case of a leak at the mechanical seals, the seal housing has windows to allow for any waste to leak back into the tank and not leak across the bearing housing seal faces and into the hydraulic motor.

Mechanical seals are used to prevent radioactive fluid from leaking into the hydraulic fluid. Because the mechanical seals must remain operational for the life of the pump, barrier fluid is provided at the seal faces to cool and lubricate, and thus, reduce wear. Barrier fluid becomes hot as it is circulated around the seals, which limits its ability to reduce wear. A helical heat exchanger to cool the barrier fluid is integrated around the discharge piping.

In tanks with large amounts of liquid waste the pump must be fully submerged. This causes an increase in differential pressure between the waste and the seal barrier fluid. To keep a positive differential pressure between the waste and the barrier fluid, an accumulator has a piston which compensates pressure in the barrier fluid providing the positive pressure to prevent radioactive material from entering the system.

The portions of the pump that will become wetted when the pump is submerged are constructed out of stainless steel to prevent rust, corrosion, and allow for decontamination. Fasteners used have a 12-point socket head to limit the pockets on the machine to prevent waste from accumulating, to further help with decontamination when removing equipment for disposal.

Operation of the pump can be controlled by a hydraulic power unit located outside of the tank. The onsite radioactive transport piping attached to the discharge of the pump system has pressure requirements that must not be exceeded. The hydraulic power unit oil pump is displacement limited to prevent the pump from creating enough pressure to exceed the discharge piping requirements.

When the pump is stopped, the abrasive waste in the line drains back into the pump. This can cause abrasive particles to become wedged in the small spaces between impellers and housings. Hardened impellers are used to prevent the particles from jamming the pump.

Being designed for a radioactive environment requires the pump to be installed for the duration of a tank campaign. Because no maintenance may be performed during that time, greased bearings are used to ensure proper function for the full campaign.

Many of the tanks have flat bottoms; therefore, reducing the waste level to an acceptable volume requires the drawdown capability of the pump to be less than approximately ½-inch of liquid. This invention incorporates a flat shaped inlet at the suction end, mounted very close to the base of the pump, that allows a pump drawdown of approximately ⅜".

For pumping thicker liquids, dilution ports are provided at the pump suction to add water to the waste stream to meet the criticality required for the waste.

The system includes an integrated, retractable backstop that captures and directs the flow of the waste liquid into the pump suction for flat bottom tanks. The backstop also reduces the number of particles that bypass the pump suction and therefore increases the overall efficiency of the pumping system. The backstop can also be rotated to align with the flow stream and so the suction of the pump can be de-fouled with the cleaning nozzle.

A suction strainer with ⅜-inch openings is typically provided with the pump to classify particles and meet the disposal processing requirements to prevent larger particles from entering the pump suction.

The system can also include an integrated macerator beneath the pump suction to breakdown and classify particles prior to the waste liquid entering the suction strainer. The macerator works in concert with the rotatable pump backstop to improve the volume of waste material that can be captured by the pump. The macerator can swing out of the way when not needed or it becomes fouled to increase pumping performance.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

Figure 1:
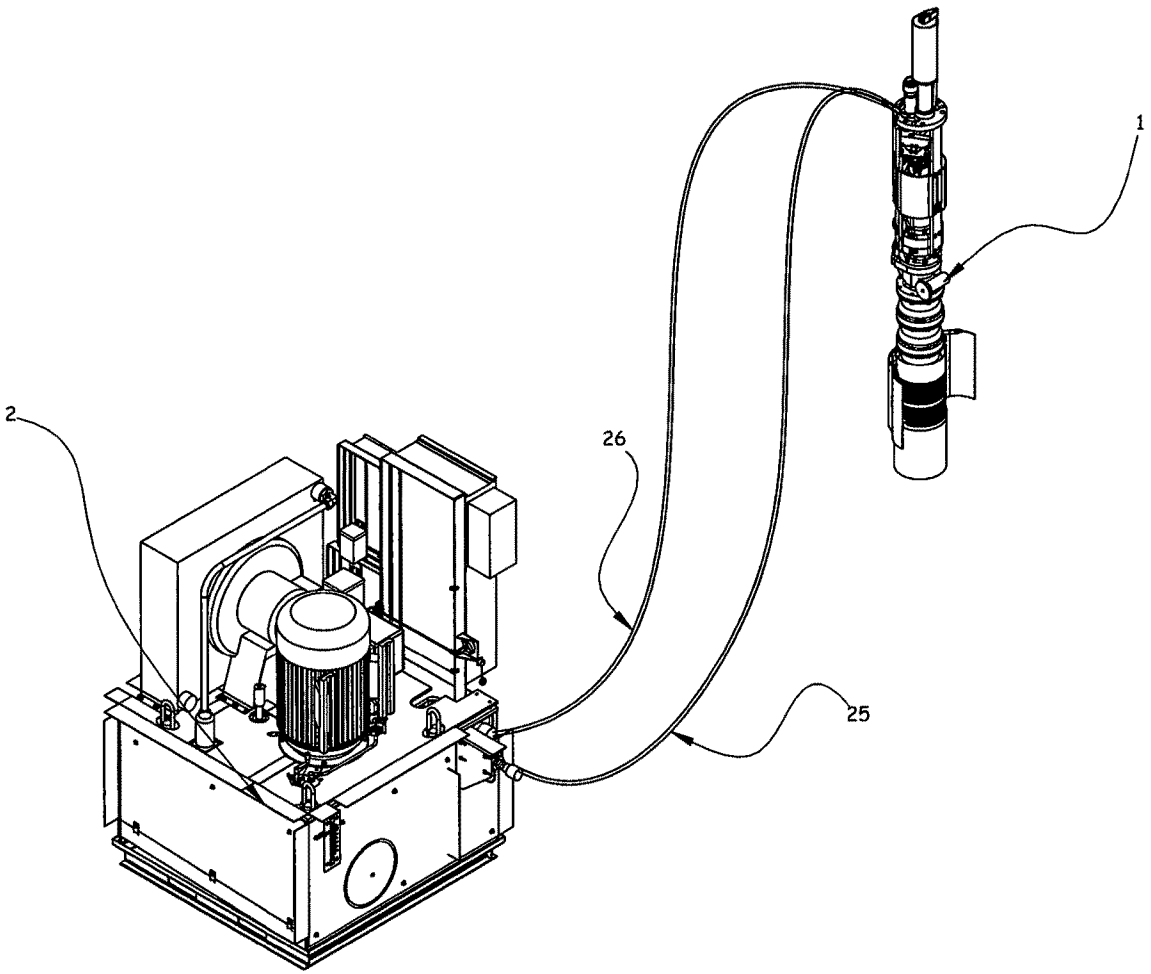
FIG. 1 is a perspective/isometric view of the nuclear abrasive slurry waste pump assembly and hydraulic power unit.
Figure 2:
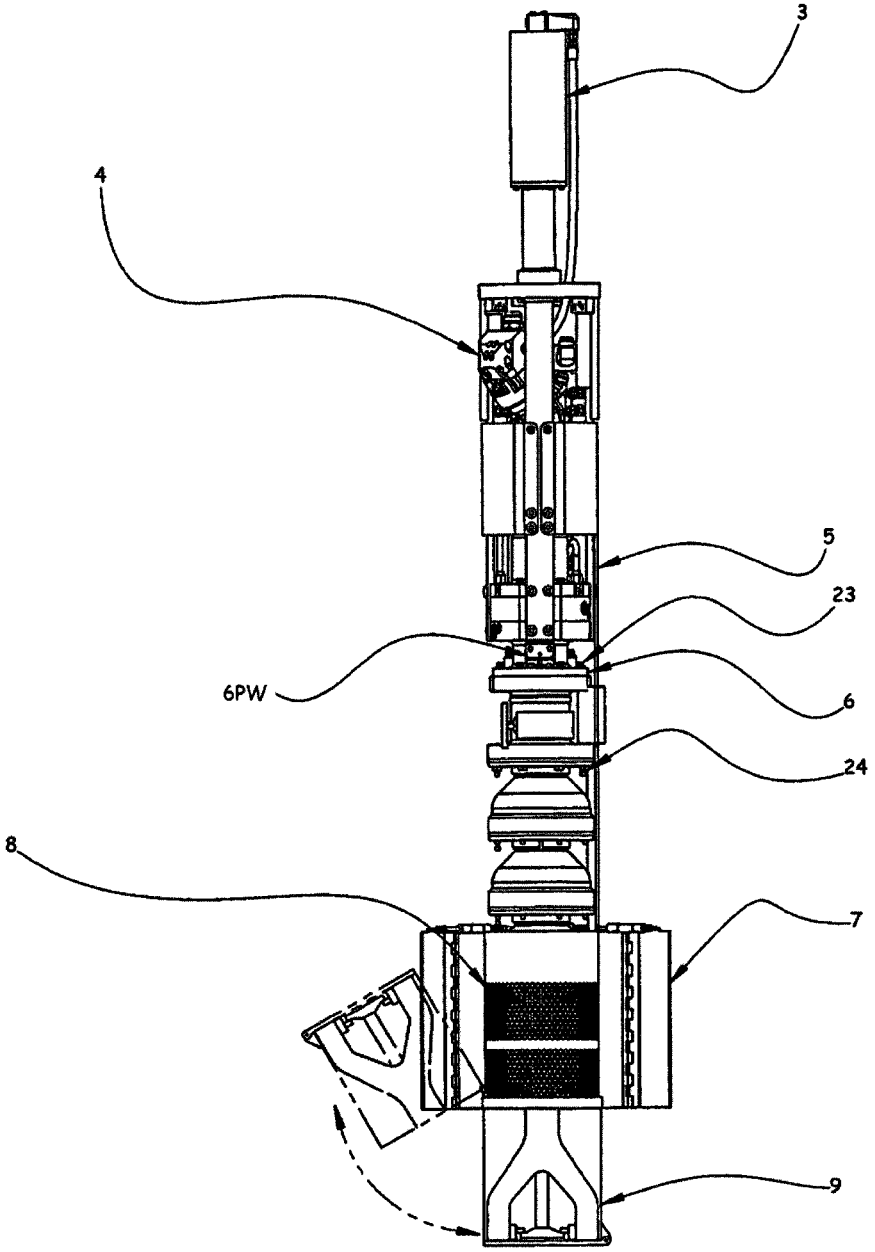
FIG. 2 is an enlarged view of the nuclear abrasive slurry waste pump assembly shown in FIG. 1 along with the macerator rotation.

1 Hydraulic pump/pump assembly
2 hydraulic power unit
3 accumulator
4 hydraulic motor
5 dilution line
6 seal housing
7 pump backstop
8 suction strainer
9 macerator
10 bladder
11 expansion cavity
12 piston
13 spring
14 pump shaft
15 pump bowl
16 carbide wear ring
17 impeller
18 discharge piping
19 barrier fluid heat exchanger
20 mechanical seal
21 riser pipe
22 waste tank
23 12 point bolt
24 Hex head cap screw
25 Hydraulic supply hose
26 Hydraulic return hose FIG. 1 is a perspective/isometric view of the nuclear abrasive slurry waste pump assembly 1 connected to hydraulic power unit 2 via a hydraulic supply hose 25 and a hydraulic return hose 26. FIG. 2 is an enlarged view of the nuclear abrasive slurry waste pump assembly shown 1 in FIG. 1 along with the macerator rotation.

Referring to FIG. 1 and FIG. 2, the nuclear abrasive slurry waste pump system can be comprised of a pump 1 with backstop 7 and macerator 9 with control from a hydraulic power unit 2. The wetted components of the pump 1 can be constructed from metal such, as but not limited to stainless steel to prevent corrosion and allow for decontamination. Where feasible, bolts, such as 12 point bolts 23 or hex head cap screws 24, that do not have an internal feature in the head can be used to prevent the buildup of hazardous waste. The use of hydraulic power can remove any potential ignition sources from electrical components that can occur with prior art systems and allows operation in tanks with explosive vapors.

Referring to FIG. 2, the nuclear abrasive slurry waste pump assembly 1 can be comprised of a multistage pump driven by a hydraulic motor 4 that can be stacked vertically to fit through an approximately 12-inch riser pipe. At the suction end of the pump can be a strainer 8 that prevents particles larger than approximately ⅜-inch in diameter from entering the pump. The face of the suction inlet can allow for a low draw down of the liquid level to an approximately ½-inch or less in the tank. For difficult liquids with high solid content, a dilution liquid can be introduced through dilution lines 5 and feed ports incorporated into the face of the suction inlet.

Figure 5:
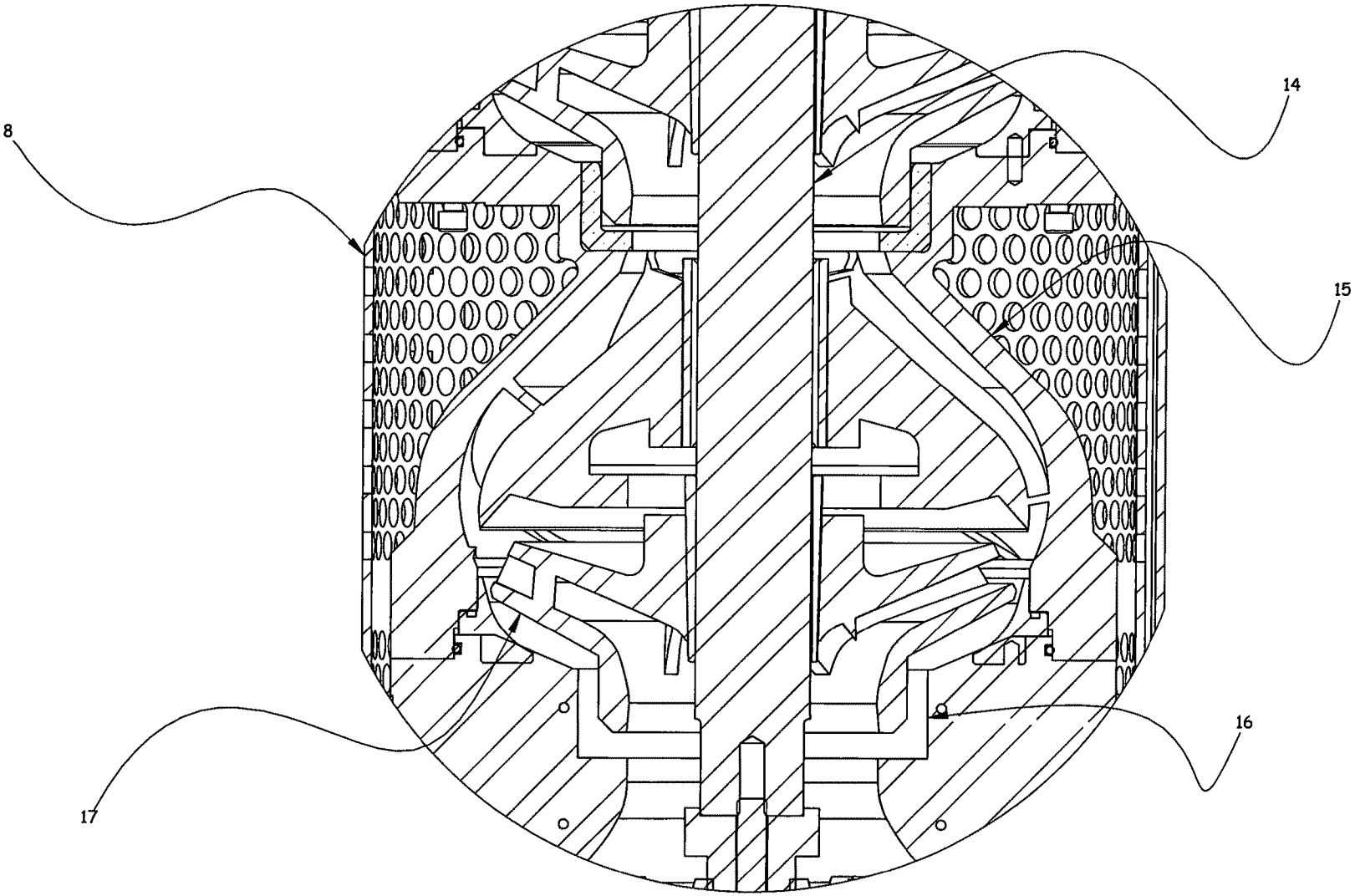
FIG. 5 is an enlarged partial cross-section view of the first stage pump of FIG. 2.

FIG. 5 is an enlarged partial cross-section view of the first stage pump of FIG. 2. FIG. 5 illustrates a single pump stage that can be comprised of an impeller 17 rotating in a bowl 15 where the suction inlet of the first stage draws liquid into the pump and directs flow into the suction of the adjacent stages until the final stage which pumps the liquid into the discharge piping 18. The pump impellers 17 can have hardened faces that rotate in wear rings 16, such as hardened carbide wear rings which can prevent particles from becoming wedged in between the two and seizing the pump. The impellers can be coupled through a common shaft 14 that is driven by the hydraulic motor 4. The drive shaft can be supported by bearings and connected to the motor through a flexible coupling. The bearings can be greased such that there is no need for additional maintenance or lubrication during the life of the pump.

Referring to FIGS. 1 and 2, the pump hydraulic motor 4 can be located above the pump, mounted to the seal housing 6 such that it is separated from the waste stream through mechanical seals, thereby eliminating the possibility of nuclear waste contaminating the hydraulic system and reaching outside of the tank. In case of a leak at the mechanical seals, the seal housing 6 can have ports or windows 6PW to allow any waste to drain back into the tank.

Figure 6:
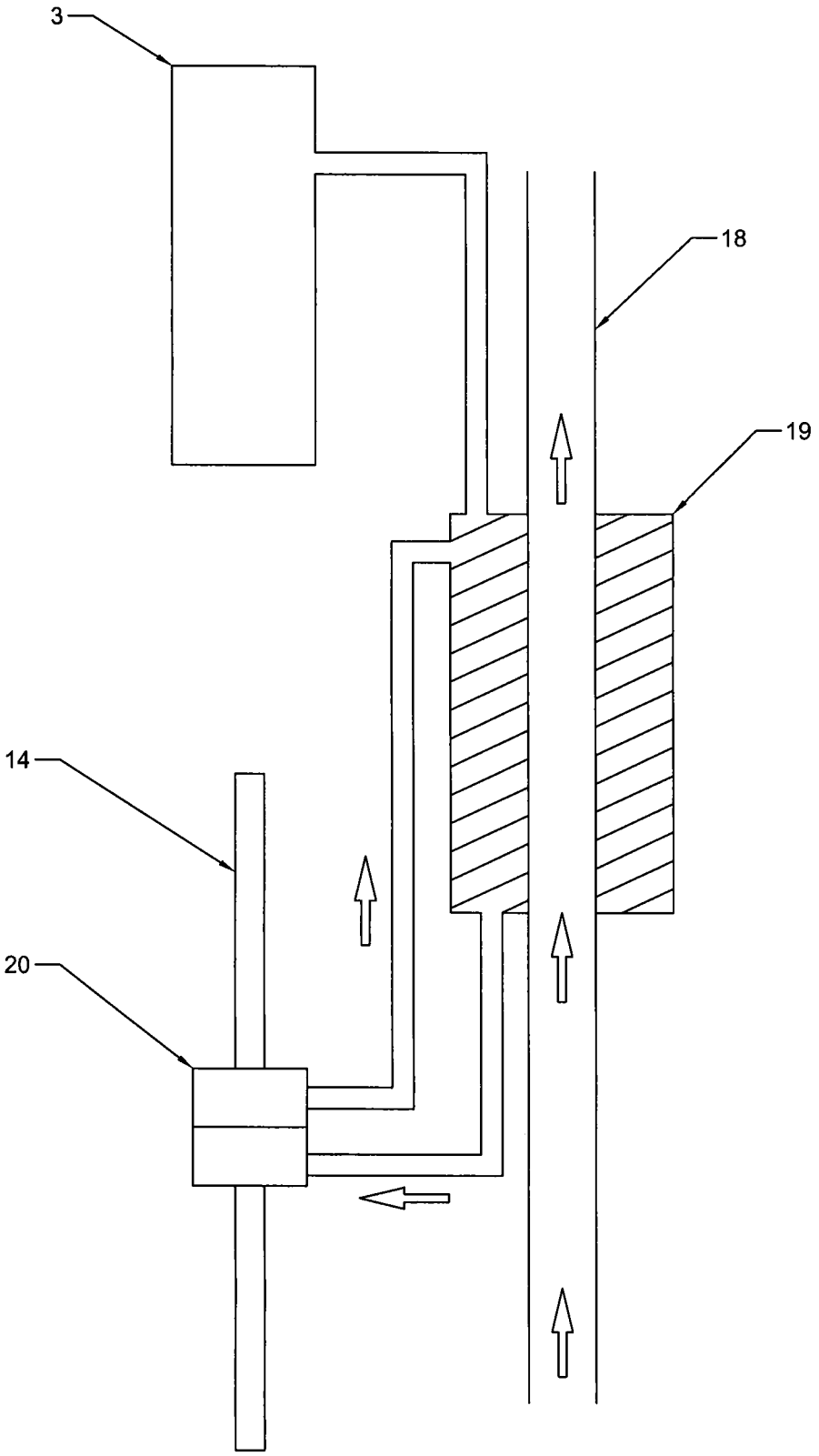
FIG. 6 is a schematic of the barrier fluid recirculation, cooling circuit that can be used with pump assembly 1 of FIGS. 1 and 2.

FIG. 6 is a schematic of the barrier fluid recirculation, cooling circuit that can be used with pump assembly 1 of FIGS. 1 and 2. Referring to FIGS. 1, 2 and 6, the mechanical seals 20 can contain a barrier fluid at the seal faces to reduce heat from friction and reduce wear on the seals. The barrier fluid can be circulated around the seals 20 and cooled through a barrier fluid heat exchanger 19 to improve the performance and increase the life of the seals. The heat exchanger 19 can be comprised of a helical path traversing the outside diameter of the discharge piping 18.

Figure 4:
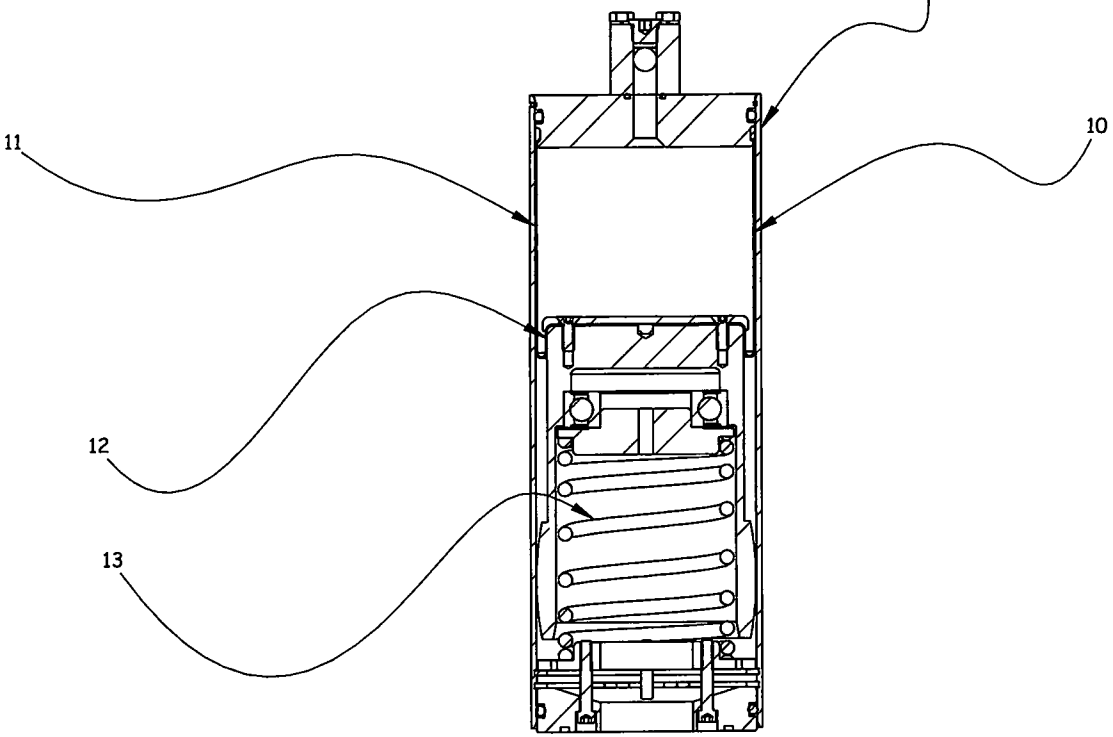
FIG. 4 is a cross-sectional view of the accumulator portion of the nuclear abrasive slurry waste pump assembly of FIG. 2.

FIG. 4 is a cross-sectional view of the accumulator portion 3 of the nuclear abrasive slurry waste pump assembly 1 of FIG. 2. FIG. 4 references an accumulator 3 that can be comprised of a chamber with expansion cavity 11 housing a rolling bladder 10, piston 12, and spring 13 that self-compensates for changes in the barrier fluid due to temperature and/or pressure.

To further improve the efficiency of the pumping system, a macerator 9 of FIG. 2 can be mounted at the suction inlet to draw in large particles, break them down to approximately ⅜-inch diameter or less, and deposit them at the suction of the pump. This can reduce the need for further processing by a cleaning nozzle and eliminates the possibility of a clogged suction.

The bottom of the macerator 9 can be actuated to evacuate any debris that has collected. Additionally, the macerator can be rotated out of the way in the event it becomes inoperable, for cleaning, or if not being employed at all. When the macerator 9 is rotated away, the nuclear abrasive slurry waste pump assembly 1 is still operable with the suction strainer to classify the particle size to approximately ⅜" or smaller.

Referring to FIGS. 1 and 2, a retractable backstop 2 can be incorporated at the suction inlet to increase the pump's efficiency by collecting matter that would otherwise bypass the pump assembly 1.

Figure 3A:
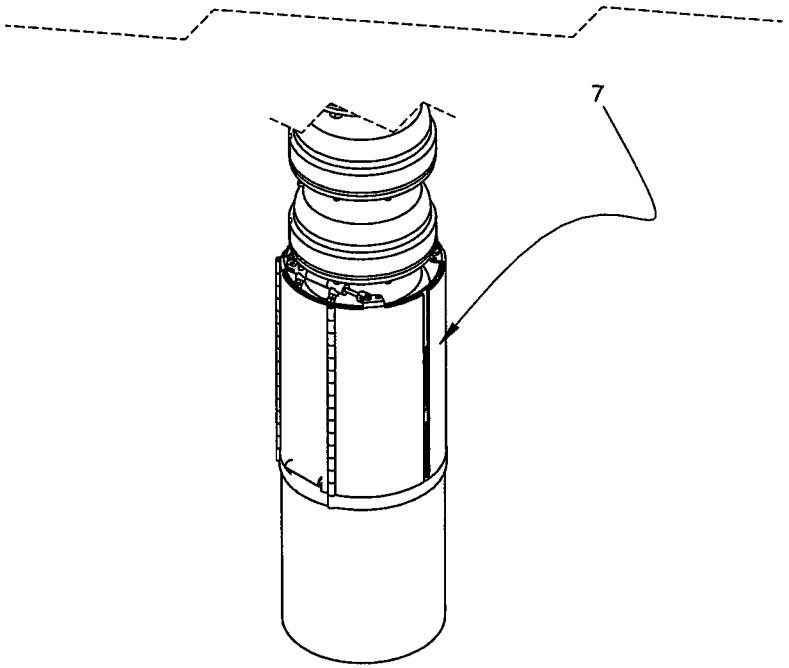
FIG. 3A is a perspective view of the pump backstop portion of the nuclear pump assembly of FIG. 2 in a closed position.
Figure 3B:
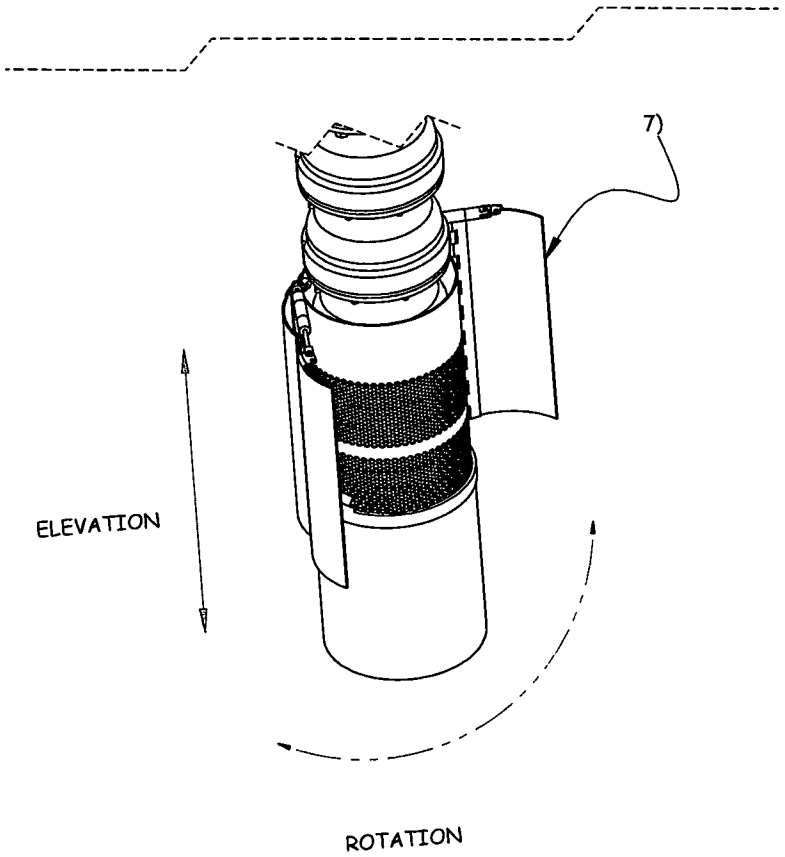
FIG. 3B is another view of the pump backstop portion of the nuclear pump assembly of FIGS. 2 and 3A with the pump backstop in an open position, and which illustrates the range of motion of the pump backstop.

FIG. 3A is a perspective view of the pump backstop portion 7 of the nuclear pump assembly 1 of FIG. 2 in a closed position. FIG. 3B is another view of the pump backstop portion 7 of the nuclear pump assembly 1 of FIGS. 2 and 3A with the pump backstop 7 in an open position, and which illustrates the range of motion of the pump backstop 7.

Referring to FIGS. 3A-3B, the backstop 7 can be comprised of wings that closely wrap around the circumference of a strainer for deployment through an approximately 12-inch diameter riser. FIG. 3B also shows the wings deployed after the nuclear abrasive slurry waste pump assembly 1 is installed into the riser pipe.

In one embodiment, the backstop 7 can be rotated independently about the pumps longitudinal axis to allow alignment with the flow of liquid. In another embodiment, the backstop 7 can be rotated with the pump as whole.

The backstop 7 can be raised and lowered to accommodate the strainer or the macerator 9 (FIG. 2). Also, the backstop 7 can be fully raised to allow for complete 360 degree access to the suction or to be cleaned by spray water.

Referring to FIGS. 1-2, the hydraulic power unit 1 can be comprised of a skid mounted pumping system that delivers hydraulic fluid to the hydraulic motor 4. The hydraulic supply pump assembly 1 can be hydraulically displacement limited to specific piping runs by a mechanical stop so that the nuclear abrasive slurry waste pump hydraulic motor 4 cannot over pressurize the discharge piping, thus keeping the system discharge pressure between approximately 0 psi and approximately 500 psi, and thus, within safe operating conditions for specific piping being used to transport the waste, and preventing protecting the piping from failures.

Figure 7:
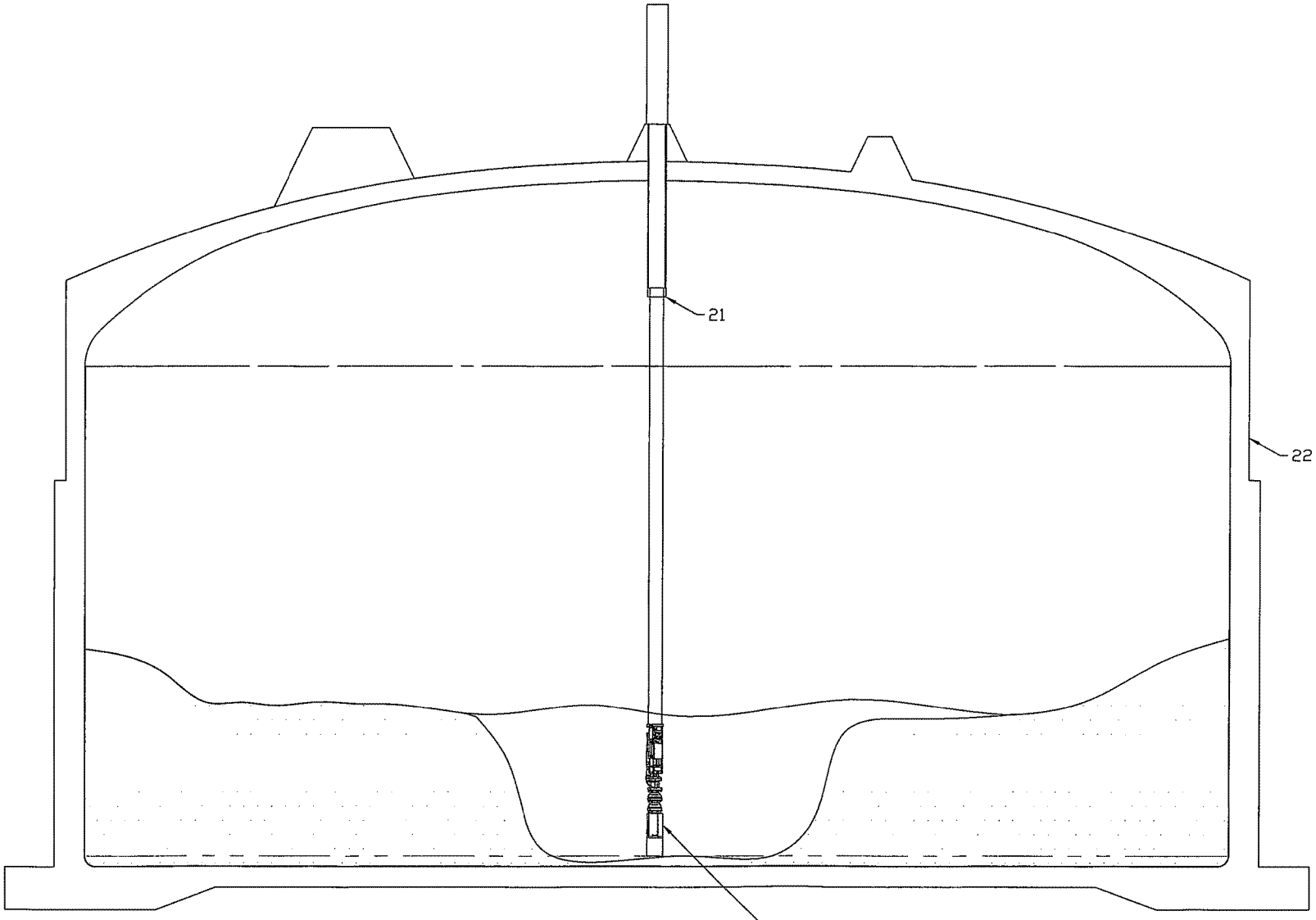
FIG. 7 illustrates a cross section view of a waste tank and the nuclear abrasive slurry waste pump of FIG. 2 installed in a typical riser.

FIG. 7 illustrates a cross section view of a waste tank and the nuclear abrasive slurry waste pump of FIG. 2 installed in a typical riser.

Referring to FIGS. 1, 2 and 7, the nuclear abrasive slurry waste pump assembly 1 with backstop 7 and macerator 9 is shown installed through an approximately 12-inch riser pipe 21 in a generic waste tank 22.

The term "approximately" can be +/−10% of the amount referenced. Additionally, preferred amounts and ranges can include the amounts and ranges referenced without the prefix of being approximately.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A nuclear abrasive slurry waste pump system comprising:

a submersible, multistage abrasive slurry pump assembly for fitting into an existing riser pipe in a waste tank;

a hydraulically driven pump motor for high power density and for safe operation in areas with hazardous and explosive vapors;

a suction inlet in the pump system to allow for establishing a prime;

a suction strainer at the suction inlet for restricting particles from entering the pump system;

one or more dilution lines to inject fluid at the suction inlet to reduce the percentage of solids in the waste liquid;

an exterior hydraulic power unit in the pump system for providing pressures in a safe operating range between approximately 0 psi and approximately 500 psi;

a pump seal housing located between the hydraulically driven pump motor and the multistage abrasive slurry pump assembly; and one or more drain windows or drain ports in the pump seal housing to carry any leakage of hazardous or contaminated fluid away from the pump seal housing and back into the waste tank.

2. The nuclear abrasive slurry waste pump system of claim 1, wherein the existing riser pipe in the waste tank includes: an approximately 12-inch diameter riser pipe.

3. The nuclear abrasive slurry waste pump system of claim 1, wherein the suction strainer prevents particles larger than to approximately ⅜-inch in diameter from entering the pump system.

4. The nuclear abrasive slurry waste pump system of claim 1, wherein the suction inlet in the pump system allows for a low draw down level of approximately ½-inch or less and capable of establishing a prime.

5. The nuclear abrasive slurry waste pump system of claim 1, further comprising:

wetted parts in the pump system constructed of stainless steel to allow for decontamination.

6. The nuclear abrasive slurry waste pump system of claim 1, further comprising:

a drive shaft connected to the hydraulic motor through a flexible coupling; and greased bearings for supporting the drive shaft, the greased bearings not needing additional lubrication for lifespan of the drive shaft of the pump system.

7. The nuclear abrasive slurry waste pump system of claim 1, further comprising:

one or more pump impellers with hardened faces to rotate in hardened, carbide wear rings to prevent particles from seizing the pump system.

8. The nuclear abrasive slurry waste pump system of claim 1, further comprising:

a backstop assembly with extendable and retractable wings, for capturing and directing flow in pump suction into the pump system.

9. The nuclear abrasive slurry waste pump system of claim 1, further comprising:

a backstop assembly to be raised and lowered so as to operate in conjunction with the strainer.

10. The nuclear abrasive slurry waste pump system of claim 1, further comprising:

a backstop assembly to be raised and lowered so as to operate in conjunction with a macerator.

11. The nuclear abrasive slurry waste pump system of claim 1, further comprising:

a backstop assembly to be raised and lifted for cleaning inside the pump system.

12. The nuclear abrasive slurry waste pump system of claim 1, further comprising:

a backstop assembly to be raised and lifted for approximately 360 degree access of the suction strainer.

13. The nuclear abrasive slurry waste pump system of claim 1, further comprising:

a macerator mounted to the suction inlet, to break down large particles from entering into the pump system.

14. The nuclear abrasive slurry waste pump system of claim 12, wherein the macerator breaks down particles entering into the pump system to a size be less than approximately ⅜-inch in diameter.

15. The nuclear abrasive slurry waste pump system of claim 1, further comprising: a rotatable macerator able to be swung out of way allowing operation of the pump with the suction strainer.

16. The nuclear abrasive slurry waste pump system of claim 1, further comprising:

one or more mechanical seals inside the pump system that prevents waste streams from contaminating hydraulic fluid inside the pump system.

17. The nuclear abrasive slurry waste pump system of claim 1, further comprising: one or more mechanical seals with recirculating barrier fluid that is cooled through a heat exchanger comprised of a helical path traversing the outside diameter of a discharge piping.

18. The nuclear abrasive slurry waste pump system of claim 1, further comprising: an accumulator with a piston that compensates for changes in the barrier fluid due to temperature and/or pressure.

19. A nuclear abrasive slurry waste pump system comprising:

a submersible, multistage pump assembly for fitting into waste tank risers as small as approximately 12-inch in diameter;

a hydraulically driven pump motor for high power density and for safe operation in areas with hazardous and explosive vapors;

a suction strainer for restricting particles from entering the pump system;

a suction inlet in the pump system to allow for establishing a prime;

a macerator mounted to the suction inlet, to break down large particles from entering into the pump system; and a hydraulic power unit in the pump system for providing pressures in a safe operating range between approximately 0 psi and approximately 500 psi;

a pump seal housing located between the pump motor and the multistage pump assembly; and one or more drain windows or drain ports in the pump seal housing to carry any leakage of hazardous or contaminated fluid away from the pump seal housing and back into a waste tank.

20. A nuclear abrasive slurry waste pump system comprising:

a submersible, multistage pump assembly for fitting into existing risers in a waste tank;

a hydraulically driven pump motor for high power density and for safe operation in areas with hazardous/explosive vapors;

a suction inlet in the pump system for establishing a prime;

a suction strainer for restricting particles from entering the pump system;

a backstop assembly to be raised and lifted for cleaning inside the pump system;

an exterior hydraulic power unit in the pump system for providing pressures in a safe operating range between approximately 0 psi and approximately 500 psi;

a pump seal housing located between the pump motor and the multistage pump assembly; and one or more drain windows or drain ports in the pump seal housing to carry any leakage of hazardous or contaminated fluid away from the pump seal housing and back into the waste tank.

* * * * *